US009957128B2

(12) United States Patent
Ichikawa

(10) Patent No.: US 9,957,128 B2
(45) Date of Patent: May 1, 2018

(54) SHEET CONVEYING DEVICE AND IMAGE FORMING APPARATUS

(71) Applicant: KONICA MINOLTA, INC., Chiyoda-ku, Tokyo (JP)

(72) Inventor: Katsuhisa Ichikawa, Chiryu (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/373,405

(22) Filed: Dec. 8, 2016

(65) Prior Publication Data

US 2017/0183185 A1 Jun. 29, 2017

(30) Foreign Application Priority Data

Dec. 25, 2015 (JP) ..... 2015-253693

(51) Int. Cl.
*B65H 5/34* (2006.01)
*B65H 29/68* (2006.01)
(Continued)

(52) U.S. Cl.
CPC ..... *B65H 29/68* (2013.01); *B65H 3/0669* (2013.01); *B65H 5/062* (2013.01); *B65H 7/02* (2013.01);
(Continued)

(58) Field of Classification Search
CPC . B65H 5/06; B65H 5/062; B65H 7/02; B65H 7/04; B65H 7/12; B65H 7/14; B65H 7/20; B65H 29/20; B65H 29/22; B65H 29/68; B65H 43/02; B65H 2403/481; B65H 2403/72; B65H 2403/722; B65H 2403/80–2403/82; B65H 2404/165; B65H 2513/22
See application file for complete search history.

(56) References Cited

U.S. PATENT DOCUMENTS 5,116,042 A * 5/1992 Hamanaka ..... G03G 15/60 271/176
5,215,300 A * 6/1993 Hiroi ..... B65H 9/14 271/176
(Continued)

FOREIGN PATENT DOCUMENTS

JP 2004333634 A 11/2004
JP 2006347772 A 12/2006

*Primary Examiner* — Prasad V Gokhale
(74) *Attorney, Agent, or Firm* — Holtz, Holtz & Volek PC

(57) ABSTRACT

A sheet conveying device includes: a sheet discharge roller disposed in a conveying path of sheets so as to discharge a sheet being conveyed to a sheet discharge tray; a conveying unit that conveys sheets on a side of the conveying path closer to an upstream side than the sheet discharge roller; a motor that rotates at a constant system speed during conveying of sheets to drive the conveying unit; a transmission mechanism that transmits power of the motor to the sheet discharge roller to rotate the sheet discharge roller; and a controller that controls an operation of the transmission mechanism, wherein the transmission mechanism changes a circumferential speed of the sheet discharge roller, and the controller performs speed reduction control of controlling the operation of the transmission mechanism to temporarily reduce the circumferential speed of the sheet discharge roller when a sheet is discharged to the sheet discharge tray.

18 Claims, 7 Drawing Sheets

(51) Int. Cl.

| | |
|---|---|
| ***B65H 29/14*** | (2006.01) |
| ***B65H 3/06*** | (2006.01) |
| ***B65H 9/16*** | (2006.01) |
| ***B65H 5/06*** | (2006.01) |
| ***B65H 7/02*** | (2006.01) |
| ***B65H 43/02*** | (2006.01) |
| ***G03G 15/00*** | (2006.01) |

(52) U.S. Cl.
CPC ..... *B65H 9/166* (2013.01); *B65H 29/14* (2013.01); *B65H 43/02* (2013.01); *G03G 15/6529* (2013.01); *B65H 2403/481* (2013.01); *B65H 2403/722* (2013.01); *B65H 2403/80* (2013.01); *B65H 2403/81* (2013.01); *B65H 2513/222* (2013.01); *B65H 2553/00* (2013.01)

(56) References Cited

U.S. PATENT DOCUMENTS

| | | | | |
|---|---|---|---|---|
| 5,221,079 | A * | 6/1993 | Most | B65H 29/048 271/202 |
| 5,316,286 | A * | 5/1994 | Takimoto | B65H 29/68 271/176 |
| 7,970,294 | B2 | 6/2011 | Shin | |
| 2011/0156336 | A1* | 6/2011 | Agata | B65H 5/062 271/3.19 |
| 2013/0043639 | A1* | 2/2013 | Takayama | B41J 13/0009 271/3.14 |
| 2015/0185673 | A1* | 7/2015 | Atay | B65H 7/02 399/389 |
| 2016/0281827 | A1* | 9/2016 | Beaugrand | B07C 3/008 |

* cited by examiner

SHEET CONVEYING DEVICE AND IMAGE FORMING APPARATUS

The entire disclosure of Japanese Patent Application No. 2015-253693 filed on Dec. 25, 2015 including description, claims, drawings, and abstract are incorporated herein by reference in its entirety.

BACKGROUND OF THE INVENTION

Field of the Invention

The present invention relates to a sheet conveying device and an image forming apparatus, and more particularly, to a sheet conveying device and an image forming apparatus in which a conveying unit that conveys a sheet and a sheet discharge roller are driven using the same motor.

Description of the Related Art

A sheet conveying device is used in an image forming apparatus or the like, for example, to convey a sheet on which an image is formed. Examples of the image forming apparatus which uses such a sheet conveying device include a multi-function peripheral (MFP) having a scanner function, a facsimile function, a copier function, a printer function, a data communication function, and a server function, a fax, a copier, and a printer.

In an apparatus which uses a sheet conveying device, it is necessary to rotate a sheet conveying roller at a high speed in order to increase the number of sheets conveyed per unit time and to secure high productivity. However, when the roller rotates at a high speed, sheets are discharged to a sheet discharge tray at a high speed by a sheet discharge roller, and the stackability of sheets discharged onto the sheet discharge tray deteriorates (the sheets on the sheet discharge tray become ill-ordered).

To solve this problem, an example in which a sheet discharge roller is driven using a motor different from a motor that drives a conveying roller, and a rotation speed of the sheet discharge roller is decreased only before sheets are discharged so that high productivity and satisfactory stackability can be secured (for example, see JP 4404876 B2 and JP 2004-333634 A).

However, in such a configuration as illustrated in JP 4404876 B2 and JP 2004-333634 A, since another motor for driving the sheet discharge roller is used to decrease the rotation speed of the sheet discharge roller only during discharging, power consumption increases and the manufacturing cost increases.

In order to achieve high productivity, satisfactory stackability, and low power consumption, it is necessary to share the motor for driving the sheet discharge roller and the motor for driving another conveying roller. For example, it is necessary to eliminate a sheet discharge motor and to use a motor close to the sheet discharge roller as a driving source of the sheet discharge motor. However, when the sheet discharge roller is driven using a motor that drives another conveying roller, the stackability may deteriorate if high productivity is to be secured without decreasing the rotation speed of another conveying roller. That is, another conveying roller and the sheet discharge roller rotate at a constant speed for conveying sheets and the sheets are discharged forcefully.

SUMMARY OF THE INVENTION

The present invention has been made to solve such a problem, and an object thereof is to provide a sheet conveying device and an image forming apparatus which have a simple configuration, low power consumption, and satisfactory stackability of sheets on a sheet discharge tray.

To achieve the abovementioned object, according to an aspect, a sheet conveying device reflecting one aspect of the present invention comprises: a sheet discharge roller disposed in a conveying path of sheets so as to discharge a sheet being conveyed to a sheet discharge tray; a conveying unit that conveys sheets on a side of the conveying path closer to an upstream side than the sheet discharge roller; a motor that rotates at a constant system speed during conveying of sheets to drive the conveying unit; a transmission mechanism that transmits power of the motor to the sheet discharge roller to rotate the sheet discharge roller; and a controller that controls an operation of the transmission mechanism, wherein the transmission mechanism can change a circumferential speed of the sheet discharge roller during conveying of sheets, and the controller performs speed reduction control of controlling the operation of the transmission mechanism to temporarily reduce the circumferential speed of the sheet discharge roller when a sheet is discharged to the sheet discharge tray.

The transmission mechanism preferably includes: a planetary gear mechanism provided on a path along which the power of the motor is transmitted; and a clutch mechanism of which the output shaft is connected to any one of a sun gear, a carrier, and an inner gear of the planetary gear mechanism, and the controller preferably performs the speed reduction control by operating the clutch.

The power of the motor is preferably transmitted to an input shaft of the clutch.

The circumferential speed of the sheet discharge roller when the clutch is connected is preferably lower than that when the clutch is disconnected.

The controller preferably performs the speed reduction control when a rear end of a sheet being conveyed passes through the conveying unit.

The controller does not preferably perform the speed reduction control when a predetermined type of sheet is conveyed.

The controller does not preferably perform the speed reduction control when a sheet discharged from the sheet conveying device is not discharged to the sheet discharge tray but is introduced into a post-processing apparatus.

The controller does not preferably perform the speed reduction control when an operation mode of the sheet conveying device is a predetermined operation mode.

The predetermined operation mode is preferably a silence mode or a power consumption reduction mode.

The sheet discharge roller is preferably connected to the transmission mechanism using a one-way clutch so that the sheet discharge roller is freely rotatable in a sheet discharge direction.

To achieve the abovementioned object, according to an aspect, an image forming apparatus reflecting one aspect of the present invention comprises an image forming unit that forms an image on a sheet according to an electrophotographic method and a sheet conveying device that conveys a sheet on which an image is formed by the image forming unit, wherein the sheet conveying device includes: a sheet discharge roller disposed in a conveying path of sheets so as to discharge a sheet being conveyed to a sheet discharge tray; a conveying unit that conveys sheets on a side of the conveying path closer to an upstream side than the sheet discharge roller; a motor that rotates at a constant system speed during conveying of sheets to drive the conveying unit; a transmission mechanism that transmits power of the motor to the sheet discharge roller to rotate the sheet discharge roller; and a controller that controls an operation of the transmission mechanism, and the transmission mechanism can change a circumferential speed of the sheet discharge roller during conveying of sheets, the controller performs speed reduction control of controlling the operation of the transmission mechanism to temporarily reduce the circumferential speed of the sheet discharge roller when a sheet is discharged to the sheet discharge tray, and the conveying unit is a fixing unit that fixes a toner image transferred to a sheet to the sheet using a fixing roller.

The transmission mechanism preferably includes: a planetary gear mechanism provided on a path along which the power of the motor is transmitted; and a clutch mechanism of which the output shaft is connected to any one of a sun gear, a carrier, and an inner gear of the planetary gear mechanism, and the controller preferably performs the speed reduction control by operating the clutch.

The power of the motor is preferably transmitted to an input shaft of the clutch.

The circumferential speed of the sheet discharge roller when the clutch is connected is preferably lower than that when the clutch is disconnected.

The controller preferably performs the speed reduction control when a rear end of a sheet being conveyed passes through the conveying unit.

The controller does not preferably perform the speed reduction control when a predetermined type of sheet is conveyed.

The controller does not preferably perform the speed reduction control when a sheet discharged from the sheet conveying device is not discharged to the sheet discharge tray but is introduced into a post-processing apparatus.

The controller does not preferably perform the speed reduction control when an operation mode of the sheet conveying device is a predetermined operation mode.

The predetermined operation mode is preferably a silence mode or a power consumption reduction mode.

The sheet discharge roller is preferably connected to the transmission mechanism using a one-way clutch so that the sheet discharge roller is freely rotatable in a sheet discharge direction.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 7 is a diagram for describing an operation of the transmission mechanism when a clutch is turned on.

DESCRIPTION OF THE PREFERRED EMBODIMENTS

Hereinafter, an image forming apparatus which uses a sheet conveying device according to an embodiment of the present invention will be described with reference to the drawings. However, the scope of the invention is not limited to the illustrated examples.

The image forming apparatus is a multi-function peripheral (MFP) that has a print function of conveying a sheet using a roller and printing an image on the sheet according to an electrophotographic method, a server function of storing document data or the like in a hard disk drive (HDD) or the like, and other functions. The image forming apparatus can form a color image on a sheet being conveyed according to an electrophotographic method which performs intermediate transfer, for example.

Embodiment

An overall configuration of an image forming apparatus according to the present embodiment will be described.

[Overall Configuration of Image Forming Apparatus]

Figure 1:
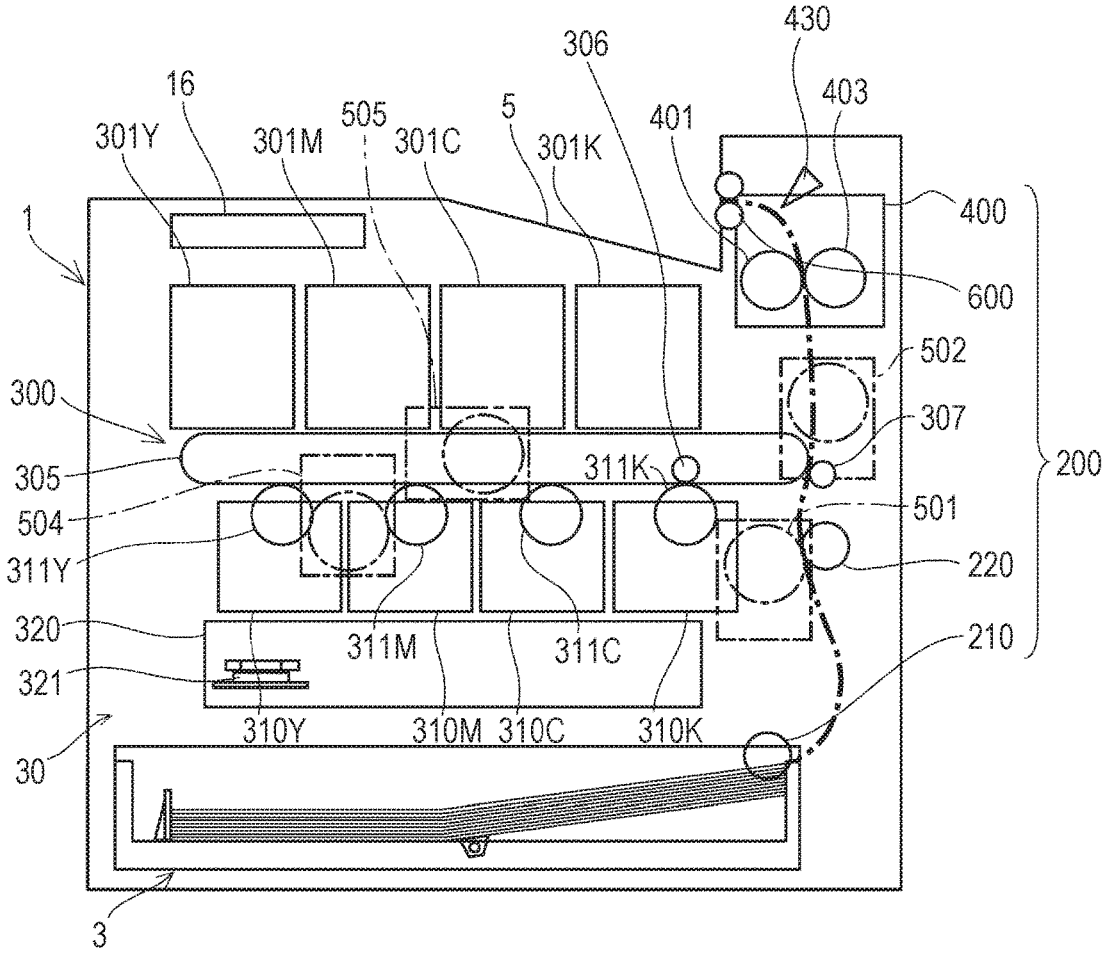
FIG. 1 is a side view illustrating a hardware configuration of an image forming apparatus according to an embodiment of the present invention.

FIG. 1 is a side view illustrating a hardware configuration of an image forming apparatus according to an embodiment of the present invention.

Referring to FIG. 1, an image forming apparatus (an example of a sheet conveying device) 1 includes a sheet feeding cassette 3, a sheet discharge tray 5, a print unit 30, and a power supply unit 16.

The sheet feeding cassette 3 is disposed in a lower part of the image forming apparatus 1 so as to be removed from and inserted into a housing of the image forming apparatus 1. Sheets loaded on each sheet feeding cassette 3 are fed from the sheet feeding cassette 3 one by one during printing and are supplied to the print unit 30.

The sheet discharge tray 5 is disposed on an upper side of the housing of the image forming apparatus 1. The image forming apparatus 1 conveys a sheet on which an image is formed by the print unit 30 inside the housing and discharges the sheet onto the sheet discharge tray 5.

The print unit 30 is disposed inside the housing of the image forming apparatus 1. The print unit 30 includes a conveying unit 200, a toner image forming unit 300, a fixing device 400, a driving unit (illustrated in FIG. 2) 500. The print unit 30 is configured to be able to combine images of the four colors CMYK according to so-called a tandem method to form a color image on a sheet.

The conveying unit 200 includes a sheet feeding roller 210 and a registration roller 220. The sheet feeding roller 210 and the registration roller 220 each are two opposing rollers, for example, and convey a sheet by rotating the rollers with the sheet interposed therebetween. The sheet feeding roller 210 feeds sheets from the sheet feeding cassette 3 one by one. A sheet is fed inside the housing of the image forming apparatus 1 by the sheet feeding roller 210. The registration roller 220 conveys the sheet fed by the sheet feeding roller 210 to the toner image forming unit 300.

Moreover, the conveying unit 200 includes the fixing device 400 and a sheet discharge roller 600. The sheet discharge roller 600 is disposed on the most downstream side in a sheet conveying path. The fixing device 400 is disposed closer to the upstream side than the sheet discharge roller 600 in the sheet conveying path. The fixing device 400 also functions as a conveying unit that conveys a sheet having an image formed thereon to the sheet discharge roller 600. The sheet discharge roller 600 discharges a sheet conveyed by the registration roller 220 to the sheet discharge tray 5. The conveying unit 200 may further have a roller used for conveying a sheet.

The toner image forming unit 300 includes four color toner bottles 301Y, 301M, 301C, and 301K (hereinafter sometimes referred to collectively as a toner bottle 301), an intermediate transfer belt 305, a primary transfer roller 306, a secondary transfer roller 307, four sets of developing units 310Y, 310M, 310C, and 310K (hereinafter sometimes referred to collectively as a developing unit 310), and a laser scan unit 320.

The yellow toner bottle 301Y, the magenta toner bottle 301M, the cyan toner bottle 301C, and the black toner bottle 301K store toner of the respective CMYK colors of yellow (Y), magenta (M), cyan (C), and black (K), respectively.

The intermediate transfer belt 305 has a circular form and is stretched between two rollers. The intermediate transfer belt 305 rotates in an interlocked manner with the conveying unit 200. The secondary transfer roller 307 is disposed so as to face a portion of the intermediate transfer belt 305 being in contact with one of the rollers. A sheet is conveyed while being sandwiched between the intermediate transfer belt 305 and the secondary transfer roller 307.

In the present embodiment, the secondary transfer roller 307 is always in contact with the intermediate transfer belt 305.

The developing unit 310 includes a photoconductor 311 (including photoconductors 311Y, 311M, 311C, and 311K provided in each developing unit), a charger 312 (illustrated in FIG. 2), a developing section 313 (illustrated in FIG. 2), and a cleaner. The yellow developing unit 310Y, the magenta developing unit 310M, the cyan developing unit 310C, and the black developing unit 310K are disposed to form images of the colors Y, M, C, and K, respectively. The developing units 310 are arranged in a line immediately below the intermediate transfer belt 305.

A charging bias voltage is applied to the charger 312. As a result, the charger 312 electrifies the surface of the photoconductor 311.

The laser scan unit 320 forms an electrostatic latent image on the surface of the photoconductor 311 by scanning laser light on each photoconductor 311.

The developing section 313 forms a toner image on the photoconductor 311 by developing the electrostatic latent image using a developing roller, for example. The developing section 313 develops the electrostatic latent image using a two-component developer that contains carrier and toner. In the present embodiment, the toner is charged to the negative (minus) polarity.

The toner image forming unit 300 forms a toner image on the photoconductor 311 in the developing unit 310 of each color in the above-described manner. The toner image of each color is transferred to the intermediate transfer belt 305 by the primary transfer roller 306, and then, the toner image on the intermediate transfer belt 305 is transferred to a sheet conveyed between the intermediate transfer belt 305 and the secondary transfer roller 307. When the amount of the toner in the developing unit 310 decreases due to image formation, the toner stored in the toner bottle 301 of each color is supplied to the developing unit.

The fixing device 400 includes a fixing roller 401 and a pressure roller 403. The fixing device 400 conveys a sheet having the toner image formed thereon with the sheet sandwiched between the fixing roller 401 and the pressure roller 403 and heats and pressurizes the sheet. In this way, the fixing device 400 melts the toner adhering to the sheet to fix the toner to the sheet and forms an image on the sheet. The sheet having passed through the fixing device 400 is discharged from the housing of the image forming apparatus 1 to the sheet discharge tray 5 by the sheet discharge roller 600.

A sheet end sensor 430 is disposed at a predetermined position of the sheet conveying path located closer to the downstream side than the fixing device 400 and closer to the upstream side than the sheet discharge roller 600. The sheet end sensor 430 can detect a front end and a rear end of a sheet conveyed on the conveying path.

The driving unit 500 includes a main motor 501, a fixing motor 502, a color developing motor 504, and a color photoconductor motor 505. The driving unit 500 is driven under a control unit 20 (illustrated in FIG. 2) to be described later. The main motor 501 drives the conveying unit 200 from a sheet feeding step to a transfer step and conveys a sheet to the conveying unit 200. Moreover, the main motor 501 drives the intermediate transfer belt 305, the black photoconductor 311K, the primary transfer roller 306, and the secondary transfer roller 307. The fixing motor 502 drives the fixing device 400 and the sheet discharge roller 600. The color developing motor 504 drives the developing units 310Y, 310M, and 310C of the yellow, magenta, and cyan. The color photoconductor motor 505 drives the photoconductors 311Y, 311M, and 311C of yellow, magenta, and cyan.

During driving of the image forming apparatus 1, the respective motors 501, 502, 504, and 505 rotate at mutually corresponding constant system speeds (process speeds). Due to this, the respective units of the print unit 30 operate in synchronization to convey sheets and images are formed on the sheets.

The power supply unit 16 supplies a driving power and a control power which are relatively low voltages and supplies a high-voltage power used for transfer of a toner image or the like. The power supply unit 16 is provided inside the housing of the image forming apparatus 1. The power supply unit 16 is connected to a commercial power source and supplies electric power to respective units of the image forming apparatus 1 based on the commercial power source.

Figure 2:
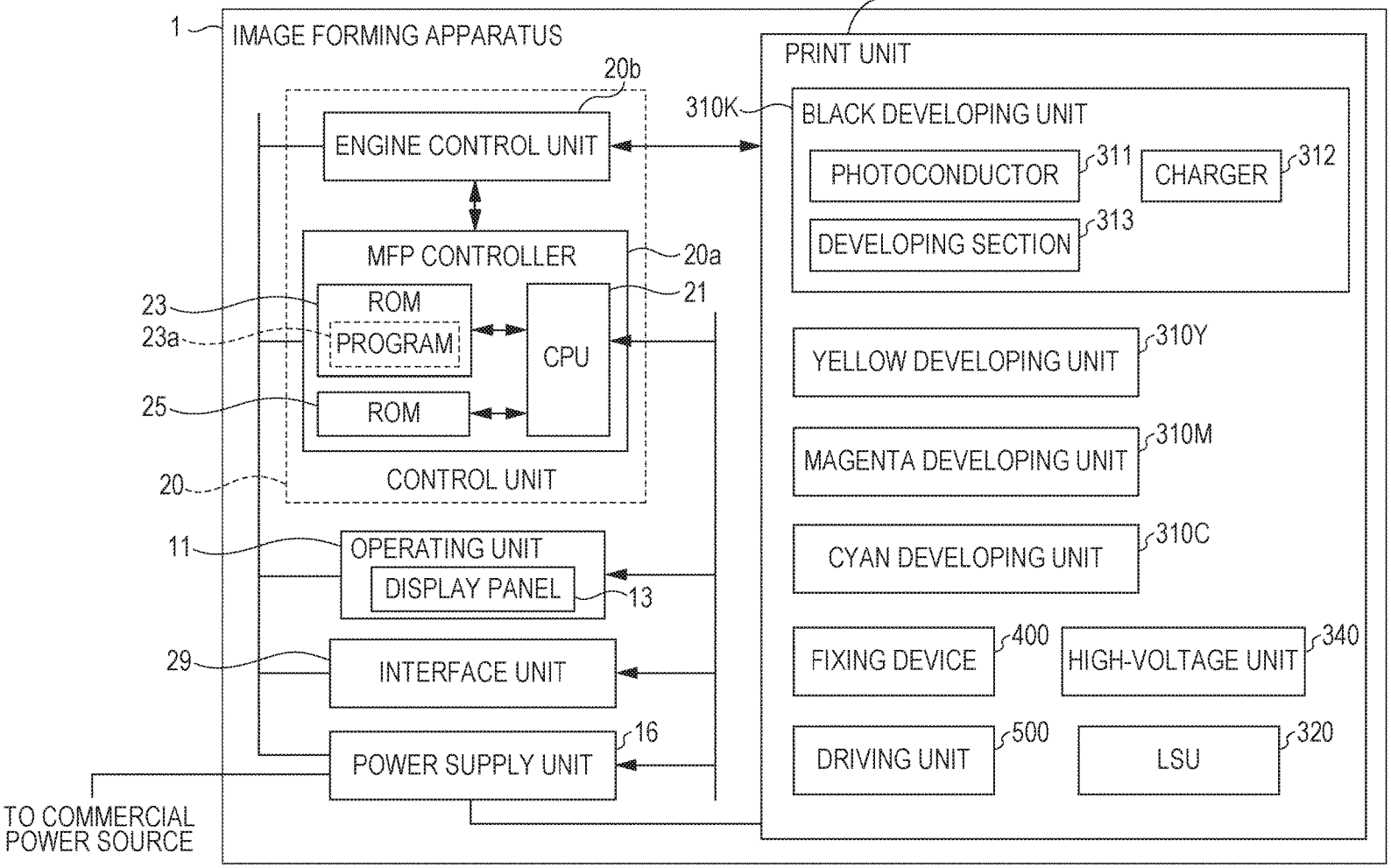
FIG. 2 is a block diagram illustrating a configuration of an image forming apparatus.

FIG. 2 is a block diagram illustrating a configuration of the image forming apparatus 1.

Referring to FIG. 2, the image forming apparatus 1 further includes an operating unit 11, a control unit 20, and an interface unit 29.

The control unit 20 generally includes an MFP controller 20*a* and an engine control unit 20*b*. The MFP controller 20*a* mainly controls an overall operation of the image forming apparatus 1. The engine control unit 20*b* operates based on the control of the MFP controller 20*a* and mainly controls the operation of the print unit 30.

The operating unit 11 is disposed in the housing of the image forming apparatus 1 so as to be operable by a user. A display panel 13 is disposed in the operating unit 11. The display panel 13 is a liquid crystal display (LCD) having a touch panel, for example. The display panel 13 displays a guidance screen to a user, displays operation buttons, and receives a touch operation from the user. The display panel 13 displays information by being controlled by the MFP controller 20*a*. When the display panel 13, the operation buttons (not illustrated), and the like are operated by the user, the operating unit 11 transmits an operation signal or a predetermined command corresponding to the operation to the CPU 21. That is, the user can cause the image forming apparatus 1 to execute various operations by operating the operating unit 11.

The MFP controller 20*a* includes the CPU 21, a read only memory (ROM) 23, a random access memory (RAM) 25, and the like. The MFP controller 20*a* is connected to a system bus together with the operating unit 11, a nonvolatile memory 27, the interface unit 29, the power supply unit 16, and the like. In this way, the MFP controller 20*a* and the respective units of the image forming apparatus 1 are connected so as to be able to transmit and receive signals.

The CPU 21 controls various operations of the image forming apparatus 1 by executing a control program 23*a* or the like stored in the ROM 23, the RAM 25, or another nonvolatile memory or the like. When an operation signal is transmitted from the operating unit 11 and an operation command is transmitted from a client PC or the like, the CPU 21 executes the control program 23*a* corresponding to the signal and command. In this way, the image forming apparatus 1 performs an operation according to the operation or the like on the operating unit 11 by the user.

The ROM 23 is a flash memory (a flash ROM), for example. Data used for operating the image forming apparatus 1 is stored in the ROM 23. Moreover, the control program (program) 23*a* for performing various programs of the image forming apparatus 1 is stored in the ROM 23. In addition to this, function setting data or the like of the image forming apparatus 1 may be stored in the ROM 23. The CPU 21 performs a predetermined process to read data from the ROM 23 and write data to the ROM 23. The ROM 23 may be a non-rewritable ROM.

The RAM 25 is a main memory of the CPU 21. The RAM 25 is used for storing data necessary when the CPU 21 executes the control program 23*a*.

The configuration of the control unit 20 is not limited to this.

The interface unit 29 is configured by combining a hardware unit such as a network interface card (NIC) and a software unit that performs communication using a predetermined communication protocol, for example. The interface unit 29 connects the image forming apparatus 1 to an external network such as LAN. In this way, the image forming apparatus 1 can communicate with an external apparatus such as a client PC connected to an external network. The image forming apparatus 1 can receive jobs from a client PC. Moreover, the image forming apparatus 1 can transmit image data to the client PC and transmit the image data using an E-mail via a mail server or the like.

The interface unit 29 may be configured to be able to connect to an external network by wireless communication. The interface unit 29 may be a universal serial bus (USB) interface, for example. In this case, the interface unit 29 allows the image forming apparatus 1 to communicate with an external apparatus connected via a communication cable.

The print unit 30 further includes a high-voltage unit 340. The high-voltage unit 340 generates a high voltage used for allowing each developing unit 310 to generate a toner image and generates a high output voltage for charging the primary transfer roller 306 and the secondary transfer roller 307. The respective units of the print unit 30 perform various operations by being controlled by the engine control unit 20*b*. That is, the operation of the print unit 30 is controlled by the control unit 20.

The control unit 20 can allow the image forming apparatus 1 to operate in several operation modes. Although an operation mode of the image forming apparatus 1 is designated when information is transmitted from a user or an operation is input by the user, the control unit 20 may determine the operation mode by itself based on a predetermined condition.

Examples of the operation mode include a normal operation mode and an operation mode different from the normal operation mode.

For example, a power consumption reduction mode, each unit of the image forming apparatus 1 is driven in such a manner that power consumption is smaller than that during driving in the normal operation mode. In this way, the power consumed by the image forming apparatus 1 is reduced.

Moreover, for example, in a silence mode, each unit of the image forming apparatus 1 is driven in such a manner that the magnitude of sound generated during driving of the image forming apparatus 1 is smaller than that during driving in the normal operation mode. In this way, the noise generated from the image forming apparatus 1 decreases.

[Description of Speed Reduction Control]

Conventionally, a configuration for rotating the sheet discharge roller 600 generally uses the fixing motor 502 as a driving source. In this case, using the fixing motor 502 as a driving source, the sheet discharge roller 600 is rotated at approximately the same circumferential speed as the circumferential speed of the fixing roller 401. However, when the sheet conveying speed is increased to improve the productivity, the sheet discharge speed increases, and the stackability deteriorates.

A reduction ratio may be set in advance so that the rotation speed of the sheet discharge roller 600 is lower than that of the fixing roller 401. However, the amount of sheet loop between the fixing roller 401 and the sheet discharge roller 600 may become too large and a subsequent sheet may catch up with a preceding sheet whereby sheets may be conveyed in an overlapping state.

In contrast, in the present embodiment, the control unit 20 can perform speed reduction control of temporarily decreasing the circumferential speed of the sheet discharge roller 600 when a sheet is discharged to the sheet discharge tray 5. The speed reduction control is performed by controlling an operation of the transmission mechanism 610 (illustrated in FIG. 3) for transmitting the power of the fixing motor 502 to the sheet discharge roller 600. The control unit 20 performs speed reduction control according to a detection result of a sheet end by the sheet end sensor 430. That is, the control unit 20 can determine the position of a sheet based on the detection result of the sheet end. Speed reduction control is performed when the sheet is positioned at a predetermined position.

Figure 3:
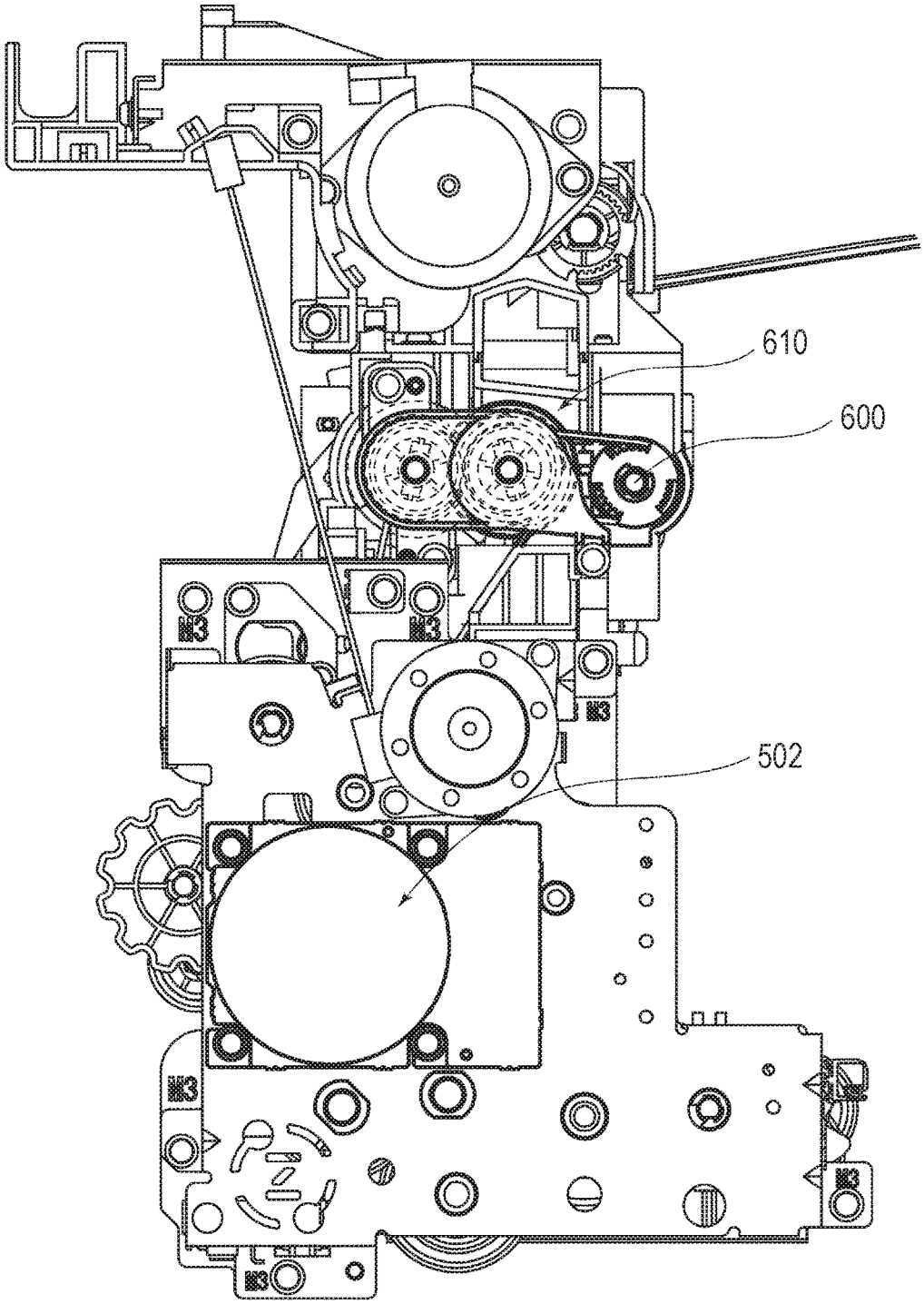
FIG. 3 is a rear view illustrating a transmission mechanism.
Figure 4:
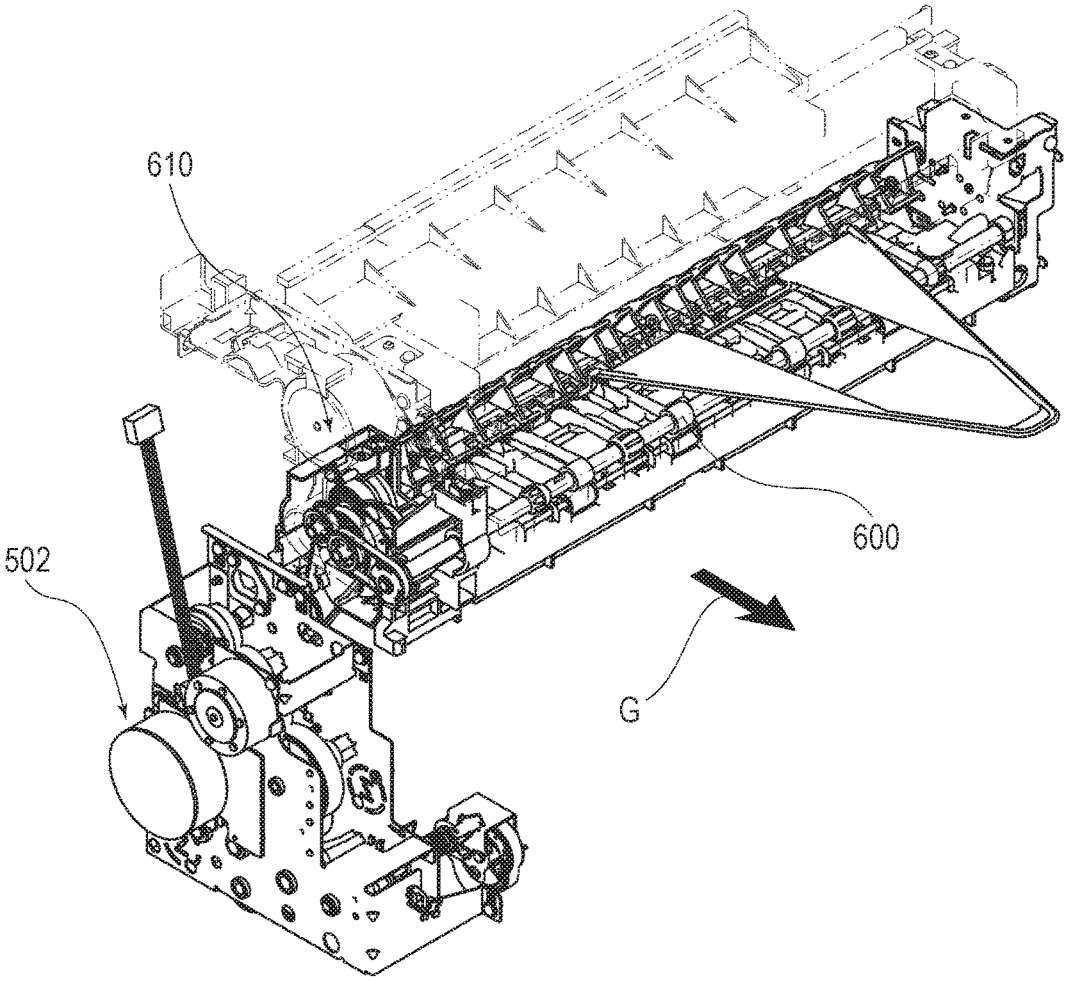
FIG. 4 is a perspective view illustrating a transmission mechanism and a sheet discharge roller.

FIG. 3 is a rear view illustrating the transmission mechanism 610. FIG. 4 is a perspective view illustrating the transmission mechanism 610 and the sheet discharge roller 600.

FIG. 3 illustrates a view (a view when seen from the opposite side from FIG. 1) when the image forming apparatus 1 is seen from a rear side. In FIG. 4, a portion of a sheet discharge unit disposed above the sheet discharge roller 600 is depicted by a two-dot chain line for the sake of description.

As illustrated in FIG. 3, a position at which the sheet discharge roller 600 is provided and a position at which the fixing motor 502 is disposed are separated from each other in an up-down direction. As illustrated in FIG. 4, the transmission mechanism 610 is configured by combining a plurality of gears and belts and a pulley and the like. The transmission mechanism 610 transmits the power of the fixing motor 502 to the sheet discharge roller 600 to rotate the sheet discharge roller 600. In FIGS. 3 and 4, arrow G indicates a sheet discharge direction.

Figure 5:
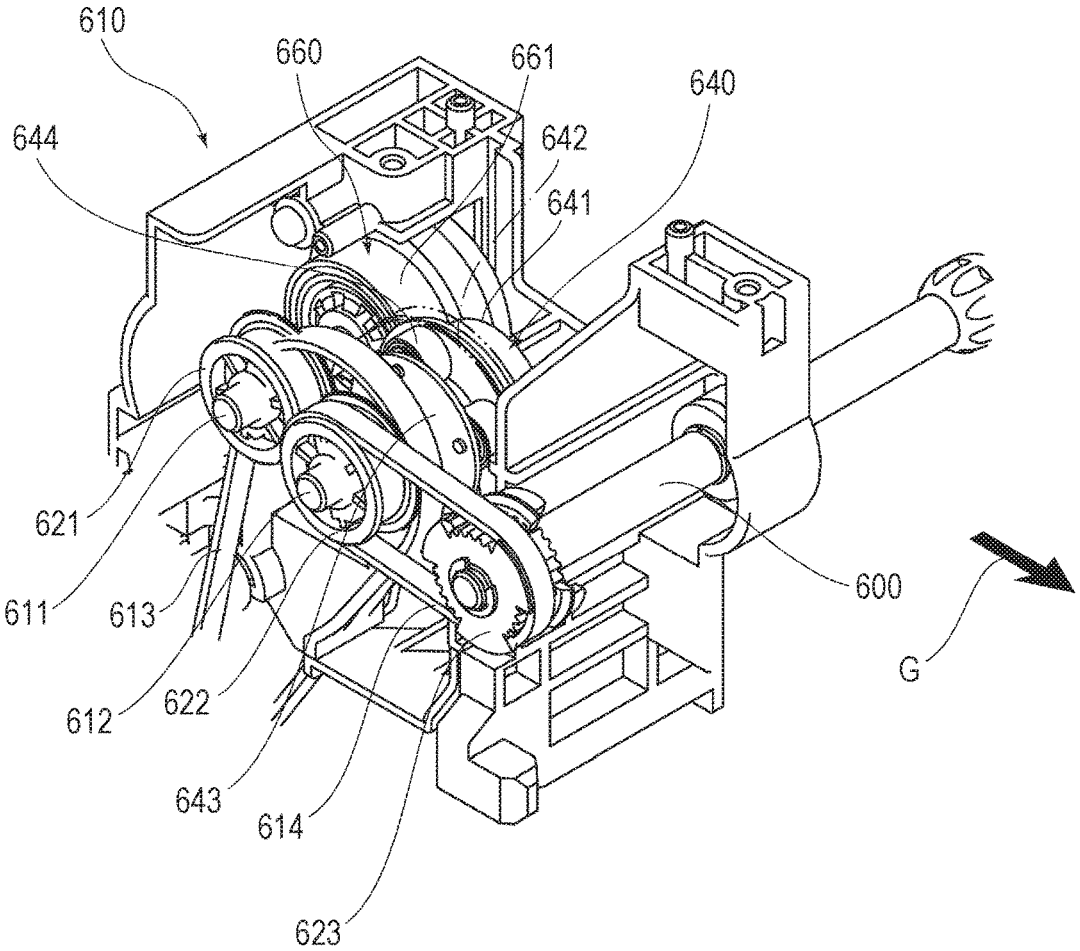
FIG. 5 is a perspective view illustrating a portion of the transmission mechanism near the sheet discharge roller at an enlarged scale.

FIG. 5 is a perspective view illustrating a portion of the transmission mechanism 610 near the sheet discharge roller 600 at an enlarged scale.

In FIG. 5, a portion (an inner gear 620) of a member that forms the transmission mechanism 610 is depicted by a two-dot chain line. Moreover, the teeth of each gear are not depicted.

As illustrated in FIG. 5, in the present embodiment, a planetary gear mechanism 640 and a clutch (a clutch mechanism) 660 are provided in the transmission mechanism 610. The transmission mechanism 610 transmits the rotating force of the fixing motor 502 to the sheet discharge roller 600 so that the circumferential speed of the sheet discharge roller 600 during conveying of sheets can be changed using the planetary gear mechanism 640 and the clutch 660.

An input shaft 611 disposed on the axis of the clutch 660, an output shaft 612 disposed on the axis of the planetary gear mechanism 640, and a sheet discharge shaft of the sheet discharge roller 600 are disposed so that a main scanning direction (a direction orthogonal to the conveying direction) is a longitudinal direction. A plurality of rubber rollers arranged in the main scanning direction is attached to the sheet discharge shaft. When the rubber roller comes into contact with a sheet, the sheet conveyed up to the sheet discharge roller 600 is discharged to the sheet discharge tray 5.

An input pulley 621 is attached to a rear side (the front side in FIG. 5) of the input shaft 611. The input pulley 621 is connected to an input side of the clutch 660.

An output pulley 622 is attached to a rear side of the output shaft 612. The output pulley 622 is connected to a carrier 643 of the planetary gear mechanism 640.

A second input pulley (not illustrated) is disposed closer to a front surface side (the deep side in FIG. 5) than the output pulley 622 of the output shaft 612. The second input pulley is connected to an inner gear 642 of the planetary gear mechanism 640. Due to this, the second input pulley does not always rotate at the same rotation speed as the output shaft 612 connected to the carrier 643.

A first belt 613 that transmits the power from the fixing motor 502 is stretched between the input pulley 621 and the second input pulley.

A second belt 614 is stretched between the output pulley 622 and a sheet discharge pulley 623 attached to a rear surface side of the sheet discharge roller 600. Due to this, the sheet discharge roller 600 rotates with rotation of the output shaft 612.

The planetary gear mechanism 640 is disposed on a front surface side of the output shaft 612. The planetary gear mechanism 640 includes a sun gear 641, the inner gear 642, and the carrier 643 that holds the plurality of planetary gears 644. The inner gear 642 rotates together with the second input pulley. The carrier 643 rotates together with the output pulley 622. The sun gear 641 is attached so as to be freely rotatable around the same rotating shaft as the output shaft 612.

The clutch 660 is attached to a front surface side of the input shaft 611. The clutch 660 turns on and off the transmission of power from an input side which rotates together with the input pulley 621 toward an output side which is on the front surface side. A clutch gear 661 is connected to the output side. The clutch gear 61 engages with the sun gear 641. The clutch 660 is an electromagnetic clutch, for example, and is configured to be turned off (do not transmit power) when power is not supplied thereto.

Since the transmission mechanism 610 is configured in the above-described manner, the transmission mechanism 610 has the following two transmission paths for the power transmitted by the first belt 613.

A first transmission path is configured as follows. Driving force is transmitted from the fixing motor 502 to the inner gear 642 in the sheet discharge unit via a gear train in the fixing device. The driving force of the inner gear 642 is transmitted to the planetary gear 644 and is output to the output pulley 622 via the carrier 643. Power of the output pulley 622 is transmitted to the sheet discharge pulley 623 by the second belt 614 and the sheet discharge roller 600 rotates.

A second transmission path is configured as follows. Driving force is transmitted from the fixing motor 502 to the input pulley 621 via a gear train in the fixing device. Although the driving force is transmitted by the first belt 613 similarly to the inner gear 642, the driving force may be transmitted using different belts for the input pulley 621 and the inner gear 642. The driving force transmitted to the input pulley 621 is transmitted to the input side of the clutch 660.

Here, when the clutch 660 is turned off, the input side rotates but the clutch gear 661 on the output side does not rotate. Due to this, the sun gear 641 does not rotate but is in a stopped state. This is because a kick spring acts on the sun gear 641 as will be described later.

Conversely, when the clutch 660 is turned on, power is transmitted from the input pulley 621 to the clutch gear 661 on the output side and the clutch gear 661 rotates. Due to this, the sun gear 641 engaged with the clutch gear 661 rotates.

When the operation of the clutch 660 is controlled by the control unit 20, the transmission mechanism 610 switches the driving state of the second transmission path. As a result, the transmission mechanism 610 switches between a low-speed driving state and a high-speed driving state of the sheet discharge roller 600. In other words, the control unit 20 temporarily switches the sheet discharge roller 600 from the high-speed driving state to the low-speed driving state to perform the speed reduction control by controlling the clutch 660.

Figure 6:
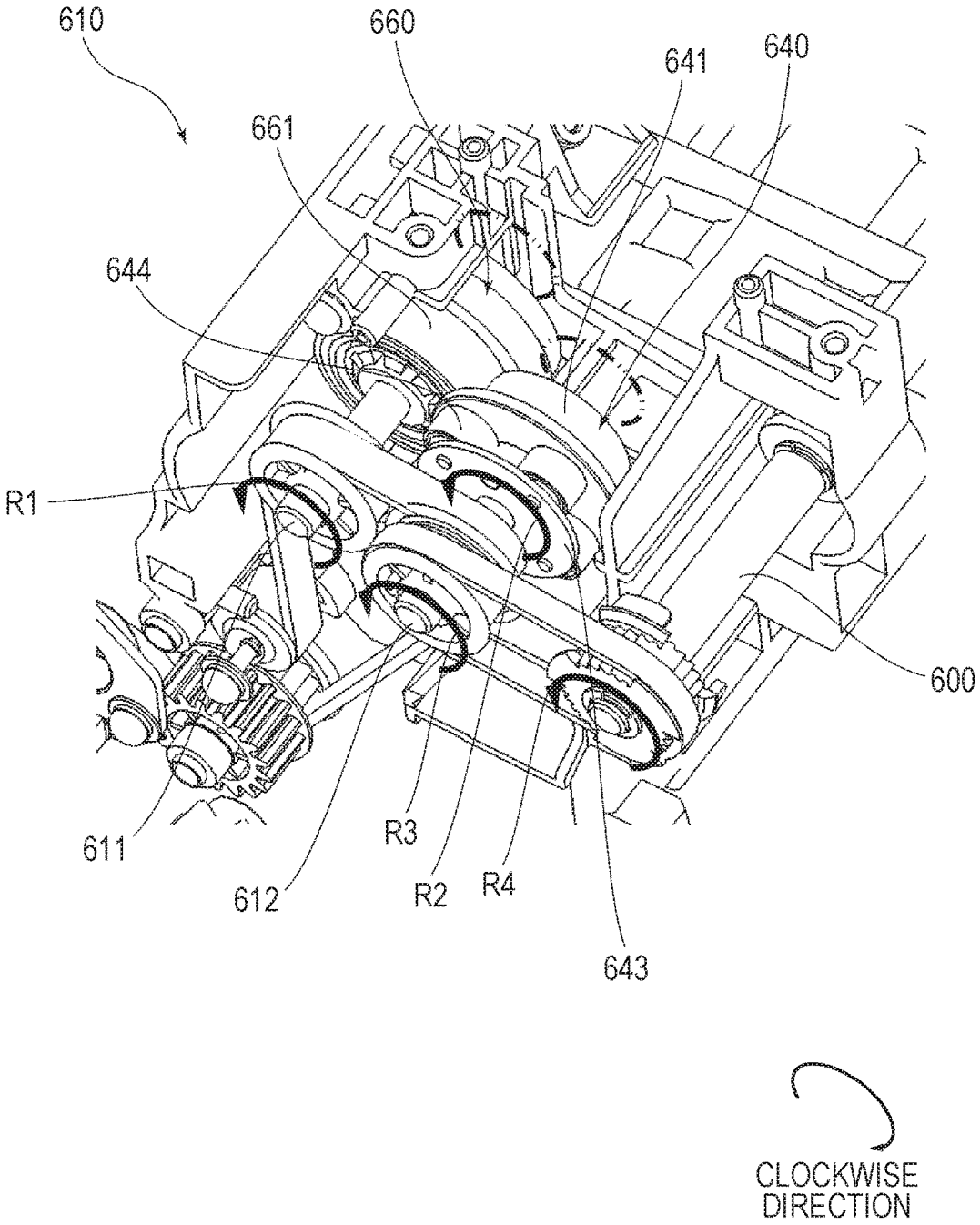
FIG. 6 is a diagram for describing an operation of the transmission mechanism when a clutch is turned off.

FIG. 6 is a diagram for describing the operation of the transmission mechanism 610 when the clutch 660 is turned off.

In FIG. 6, the inner gear 642 is not illustrated.

When the clutch 660 is turned off, the sheet discharge roller 600 rotates at a system speed (a high-speed driving state). That is, as illustrated in FIG. 6, when the clutch 660 is turned off, power is not transmitted to the output side. Due to this, in the second transmission path, a state in which the sun gear 641 engaged with the clutch gear 661 is stopped is created. In this case, power is transmitted via the first transmission path, whereby the sheet discharge roller 600 rotates in a counter-clockwise direction at a speed corresponding to the system speed.

That is, when the clutch 660 is turned off, the input pulley 621 rotates in a counter-clockwise direction as indicated by arrow R1. The inner gear (not illustrated in FIG. 6) 642 rotates in a counter-clockwise direction as indicated by arrow R2. The carrier 643 and the output pulley 622 rotate in a counter-clockwise direction as indicated by arrow R3. The sheet discharge roller 600 rotates in a counter-clockwise direction as indicated by arrow R4.

Here, in this case, the planetary gear 644 engaged with the sun gear 641 rotates at a high speed. The driving force is transmitted to the sun gear 641 as well as the carrier 643, the output pulley 622, and the sheet discharge pulley 623. When a mechanism for reliably stopping the sun gear 641 is not present, the sun gear 641 rotates and it becomes difficult to maintain a constant speed ratio between the fixing roller 401 and the sheet discharge roller 600 and sheet may be conveyed in an overlapping state. Due to this, a structure for reliably stopping the sun gear 641 is provided.

In order to maintain the stopped state of the sun gear 641, a load based on the engagement between the clutch gear 661 and the sun gear 641 may be utilized. However, generally, when the clutch 660 is turned off, a load rarely occurs, and it is difficult to reliably stop the rotation of the sun gear 641. Due to this, a mechanism for holding the sun gear 641 in a stopped state such as a structure for locking the sun gear 641 to reliably stopping the rotating force using a solenoid, for example, or a structure for stopping the sun gear 641 using the fastening force of a spring is used. In the present embodiment, the sun gear 641 is stopped by inserting a kick spring into the sun gear 641. A kick spring can stop the sun gear 641 by the fastening force on a loosening side of a spring unlike a general usage. This is because, when the sun gear 641 is stopped using the fastening force of a spring, the sun gear 641 cannot rotate even when the clutch 660 is turned on as will be described later. As compared to the case of using a solenoid, the method of using such a kick spring provides advantages that it provides satisfactory responsiveness when changing the rotation speed, the manufacturing cost decreases, and it can save the space.

Figure 7:
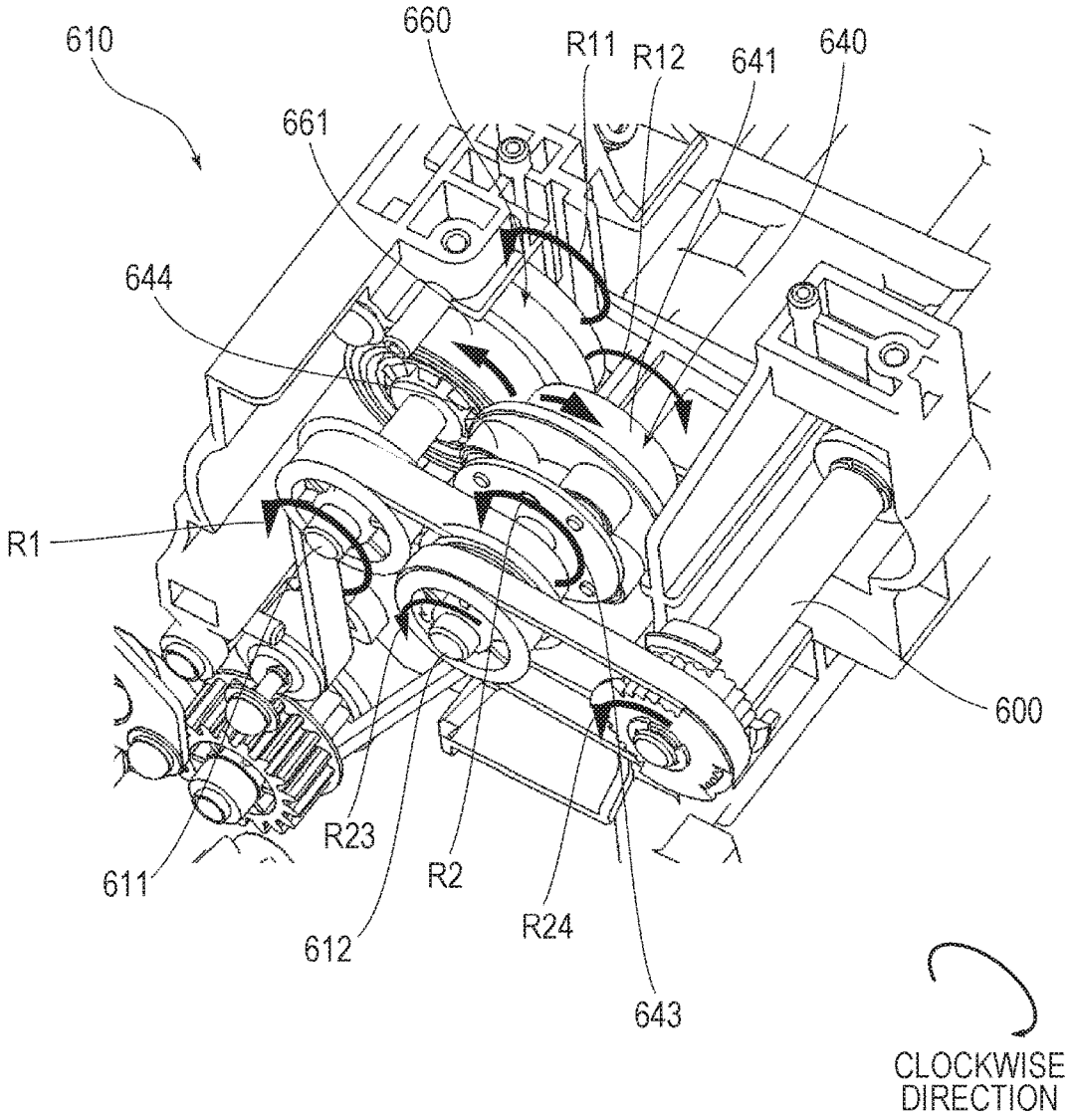

FIG. 7 is a diagram for describing the operation of the transmission mechanism 610 when the clutch 660 is turned on.

In FIG. 7, the inner gear 642 is not illustrated.

When the clutch 660 is turned on, the sheet discharge roller 600 rotates at a lower speed than the system speed (a low-speed driving state). That is, as illustrated in FIG. 7, when the clutch 660 is turned on, the power of the input pulley 621 is transmitted to the output side of the clutch 660 via the second transmission path (see arrows R1 and R11). In this case, the sun gear 641 rotates in a clockwise direction which is the opposite direction from the rotation direction of the output pulley 622 for discharging sheets via the clutch gear 661 (see arrow R12).

In the second transmission path, since the sun gear 641 rotates in the clockwise direction and the inner gear (not illustrated in FIG. 7) 642 transmits power via the first transmission path, the inner gear 642 rotates in a counter-clockwise direction similarly to when the clutch 660 is turned off (see arrow R2). In this case, since the revolving speed of the planetary gear 644 is slower than that when the sun gear 641 is stopped (rotates at the system speed), the rotation speed in the counter-clockwise direction of the output pulley 622 decreases (see arrow R23). Thus, the rotation speed of the sheet discharge roller 600 decreases (see arrow R24).

As described above, the control unit 20 can reduce the rotation speed of the sheet discharge roller 600 to be lower than the system speed by switching the clutch 660 on and off to perform speed reduction control. In general, the speed reduction control is performed immediately before a sheet passes through the sheet discharge roller 600, and the rotation speed may return to the normal system speed after a sheet passes through the sheet discharge roller 600. In the present embodiment, the sheet discharge roller 600 rotates at the system speed when the clutch 660 is turned off, and speed reduction control is performed when the clutch 660 is turned on. Therefore, it is possible to suppress the ON time of the clutch 660 as short as possible and to minimize an increase in power consumption resulting from the speed reduction control.

Moreover, the sheet discharge roller 600 and the fixing roller 401 may have the following relation. That is, when the fixing roller 401 and the sheet discharge roller 600 both convey sheets, the speed of the sheet discharge roller 600 is preferably set to the speed (that is, the system speed) of the fixing roller 401. Since the speed of the sheet discharge roller 600 is set to the system speed, bending, slipping, squeezing, or the like of sheets does not occur, and sheets can be output in a satisfactory state.

In general, the timing at which the sheet discharge roller 600 is decelerated may occur after a rear end of a sheet being conveyed passes through the fixing roller 401. However, when speed reduction control is performed immediately after the sheet passes through the fixing roller 401, a subsequent sheet may catch up with a preceding sheet and sheets may be conveyed in an overlapping state depending on a speed ratio between the sheet discharge roller 600 and the fixing roller 401. Due to this, the speed reduction control may be performed at such a timing at which a subsequent sheet does not catch up with a preceding sheet even when the speed reduction control is performed. When a timing at which the sheet discharge roller 600 is decelerated is adjusted to occur immediately before the rear end of a sheet passes through the sheet discharge roller 600, it is possible to improve the stackability of sheets on the sheet discharge tray 5.

Moreover, the speed reduction control may be performed when the system speed is relative fast only. Speed reduction control may not be performed when a predetermined type of sheets are conveyed such as a cardboard of which the PPM (prints per minute) is set to be lower than a plain paper. When a predetermined type of sheets are conveyed at a system speed lower than a normal system speed, the stackability can be maintained by discharging sheets at the slower system speed by not performing the speed reduction control. This is because, when sheets are discharged from the sheet discharge roller 600, if a sheet discharge speed is too slow, the rear end of a sheet may not be discharged by being caught at a wall surface of the sheet discharge tray 5. Due to this, it is possible to maintain the stackability for any sheet by performing the speed reduction control for plain paper and not performing the speed reduction control for a predetermined type of sheet such as a cardboard.

A post-processing apparatus may be attached to the image forming apparatus 1. The post-processing apparatus performs various post-processes such as punching or stapling. When such a post-processing apparatus is attached, the control unit 20 does not perform speed reduction control. This is because the process performed by the post-processing apparatus may take a considerable amount of time, it is necessary to convey sheets from the image forming apparatus 1 to the post-processing apparatus at a high speed.

In the present embodiment, a one-way clutch is provided in the sheet discharge pulley 623, and the sheet discharge roller 600 is rotatable in relation to the transmission mechanism 610 in a sheet discharging direction. Due to this, when the front end of a sheet discharged from the sheet discharge roller 600 is introduced into the post-processing apparatus, the post-processing apparatus can pull the sheet from the sheet discharge roller 600 regardless of the rotation speed of the sheet discharge roller 600 to continue conveying the sheet. In this way, the post-processing apparatus can convey sheets quickly. Moreover, since the force that forcibly rotates the sheet discharge roller 600 is prevented from being transmitted to the transmission mechanism 610, it is possible to prevent problems (generation of noise due to vibration or a decrease in the quality of a formed image) due to a slip formed between a sheet and the sheet discharge roller 600 and generation of tooth skipping of the transmission mechanism 610.

The control unit 20 does not perform speed reduction control when the operation mode of the image forming apparatus 1 is a predetermined operation mode. Specifically, the control unit 20 does not perform the speed reduction control when the operation mode of the image forming apparatus 1 is a silence mode or a power consumption reduction mode.

That is, since a structure in which the clutch gear 661 engages with the sun gear 641 via the clutch 660 is provided in the transmission mechanism 610, by discharging sheets without turning on the clutch 660 in the silence mode, it is possible to suppress the generation of noise as much as possible. Moreover, since sheets are discharged without turning on the clutch 660, the power for turning on the clutch 660 is not necessary and the power consumption can be reduced further.

Advantages of Embodiment

In the image forming apparatus 1 having the above-described configuration, it is possible to rotate the sheet discharge roller 600 so that the stackability is maintained without providing another motor for rotating the sheet discharge roller 600. Therefore, it is possible to simplify the configuration of the image forming apparatus 1 and to suppress the manufacturing cost of the image forming apparatus 1. Moreover, it is possible to suppress the power consumption of the image forming apparatus 1. Furthermore, it is possible to increase the productivity of the image forming apparatus 1 and to enhance the stackability of sheets on the sheet discharge tray 5.

[Others]

The motor for driving the sheet discharge roller is not limited to the motor for driving the fixing device as described above. Another motor that supplies driving force to a portion of the image forming apparatus that functions as a conveying unit that conveys sheets may be used to drive the sheet discharge roller.

Moreover, the configuration of the transmission mechanism is not limited to the above-described configuration. For example, the output shaft of the clutch may not be configured to be interlocked with the sun gear of the planetary gear mechanism. That is, one of the sun gear, the inner gear, and the carrier of the planetary gear mechanism may be connected to the clutch, another may rotate when power from the fixing motor side is input thereto, and another may rotate with interaction of these components to rotate the sheet discharge roller. The circumferential speed of the sheet discharge roller may be reduced when the clutch is turned on.

The image forming apparatus may be one of a monochrome/color copier, a printer, a facsimile apparatus, and a multi-function peripheral (MFP). The image forming apparatus is not limited to one that forms images according to an electrophotographic method but may be one that forms images according to a so-called inkjet method, for example. Moreover, the sheet conveying device can be also used in various apparatuses that convey sheets and discharges the sheets to the sheet discharge tray without being limited to the image forming apparatus.

The processes of the above-described embodiment may be realized by software and may be performed using a hardware circuit.

A program for executing the processes of the above-described embodiment can be provided, and the program may be recorded on a recording medium such as a CD-ROM, a flexible disk, a hard disk, a ROM, a RAM, a memory card, and the like and be provided to users. The program may be downloaded to an apparatus via a communication line such as the Internet. The processes described sentences in the flowchart are executed by a CPU or the like according to the program.

Although the present invention has been described and illustrated in detail, it is clearly understood that the same is by way of illustrated and example only and is not to be taken by way of limitation, the scope of the present invention being interpreted by terms of the appended claims. The scope of the present invention is intended to include all modifications within the same meaning and range as those of equivalents of the appended claims.

What is claimed is:

1. A sheet conveying device comprising:

a sheet discharge roller disposed in a conveying path of sheets so as to discharge a sheet being conveyed to a sheet discharge tray;

a conveying unit that conveys sheets on a side of the conveying path closer to an upstream side than the sheet discharge roller;

a motor that rotates at a constant system speed during conveying of sheets to drive the conveying unit;

a transmission mechanism that transmits power of the motor to the sheet discharge roller to rotate the sheet discharge roller;

a sheet end sensor configured to detect a front end and a rear end of a sheet being conveyed on the conveying path; and a controller that controls an operation of the transmission mechanism, wherein:

the transmission mechanism can change a circumferential speed of the sheet discharge roller during conveying of sheets, the controller performs speed reduction control of controlling the operation of the transmission mechanism to temporarily reduce the circumferential speed of the sheet discharge roller when it is determined, based on a detection result by the sheet end sensor, that a sheet is discharged to the sheet discharge tray, the transmission mechanism includes:

a planetary gear mechanism provided on a path along which the power of the motor is transmitted; and a clutch mechanism an output shaft of which is connected to any one of a sun gear, a carrier, and an inner gear of the planetary gear mechanism, and the controller performs the speed reduction control by operating the clutch.

2. The sheet conveying device according to claim 1, wherein the power of the motor is transmitted to an input shaft of the clutch.

3. The sheet conveying device according to claim 1, wherein the circumferential speed of the sheet discharge roller when the clutch is connected is lower than the circumferential speed of the sheet discharge roller when the clutch is disconnected.

4. The sheet conveying device according to claim 1, wherein the controller performs the speed reduction control when it is determined, based on a detection result by the sheet end sensor, that a rear end of a sheet being conveyed passes through the conveying unit.

5. The sheet conveying device according to claim 1, wherein the controller does not perform the speed reduction control when, based on an operation input by a user, a predetermined type of sheet is set to be conveyed.

6. The sheet conveying device according to claim 1, wherein the controller does not perform the speed reduction control when a sheet discharged from the sheet conveying device is introduced into a post-processing apparatus.

7. The sheet conveying device according to claim 1, wherein the controller does not perform the speed reduction control when an operation mode of the sheet conveying device is a predetermined operation mode.

8. The sheet conveying device according to claim 1, wherein the sheet discharge roller is connected to the transmission mechanism using a one-way clutch so that the sheet discharge roller is freely rotatable in a sheet discharge direction.

9. A sheet conveying device comprising:

a sheet discharge roller disposed in a conveying path of sheets so as to discharge a sheet being conveyed to a sheet discharge tray;

a conveying unit that conveys sheets on a side of the conveying path closer to an upstream side than the sheet discharge roller;

a motor that rotates at a constant system speed during conveying of sheets to drive the conveying unit;

a transmission mechanism that transmits power of the motor to the sheet discharge roller to rotate the sheet discharge roller;

a sheet end sensor configured to detect a front end and a rear end of a sheet being conveyed on the conveying path; and a controller that controls an operation of the transmission mechanism, wherein:

the transmission mechanism can change a circumferential speed of the sheet discharge roller during conveying of sheets, the controller performs speed reduction control of controlling the operation of the transmission mechanism to temporarily reduce the circumferential speed of the sheet discharge roller when it is determined, based on a detection result by the sheet end sensor, that a sheet is discharged to the sheet discharge tray, and the controller does not perform the speed reduction control when an operation mode of the sheet conveying device is a silence mode or a power consumption reduction mode.

10. An image forming apparatus comprising:

an image forming unit that forms an image on a sheet according to an electrophotographic method; and a sheet conveying device that conveys a sheet on which an image is formed by the image forming unit, the sheet conveying device comprising:

a sheet discharge roller disposed in a conveying path of sheets so as to discharge a sheet being conveyed to a sheet discharge tray;

a conveying unit that conveys sheets on a side of the conveying path closer to an upstream side than the sheet discharge roller;

a motor that rotates at a constant system speed during conveying of sheets to drive the conveying unit;

a transmission mechanism that transmits power of the motor to the sheet discharge roller to rotate the sheet discharge roller;

a sheet end sensor configured to detect a front end and a rear end of a sheet being conveyed on the conveying path; and a controller that controls an operation of the transmission mechanism, wherein:

the transmission mechanism can change a circumferential speed of the sheet discharge roller during conveying of sheets, the controller performs speed reduction control of controlling the operation of the transmission mechanism to temporarily reduce the circumferential speed of the sheet discharge roller when it is determined, based on a detection result by the sheet end sensor, that a sheet is discharged to the sheet discharge tray, the conveying unit is a fixing unit that fixes a toner image transferred to a sheet to the sheet using a fixing roller, the transmission mechanism includes:

a planetary gear mechanism provided on a path along which the power of the motor is transmitted; and a clutch mechanism an output shaft of which is connected to any one of a sun gear, a carrier, and an inner gear of the planetary gear mechanism, and the controller performs the speed reduction control by operating the clutch.

11. The image forming apparatus according to claim 10, wherein the power of the motor is transmitted to an input shaft of the clutch.

12. The image forming apparatus according to claim 10, wherein the circumferential speed of the sheet discharge roller when the clutch is connected is lower than the circumferential speed of the sheet discharge roller when the clutch is disconnected.

13. The image forming apparatus according to claim 10, wherein the controller performs the speed reduction control when it is determined, based on a detection result by the sheet end sensor, that a rear end of a sheet being conveyed passes through the conveying unit.

14. The image forming apparatus according to claim 10, wherein the controller does not perform the speed reduction control when, based on an operation input by a user, a predetermined type of sheet is set to be conveyed.

15. The image forming apparatus according to claim 10, wherein the controller does not perform the speed reduction control when a sheet discharged from the sheet conveying device is introduced into a post-processing apparatus.

16. The image forming apparatus according to claim 10, wherein the controller does not perform the speed reduction control when an operation mode of the sheet conveying device is a predetermined operation mode.

17. The image forming apparatus according to claim 10, wherein the sheet discharge roller is connected to the transmission mechanism using a one-way clutch so that the sheet discharge roller is freely rotatable in a sheet discharge direction.

18. An image forming apparatus comprising:

an image forming unit that forms an image on a sheet according to an electrophotographic method; and a sheet conveying device that conveys a sheet on which an image is formed by the image forming unit, the sheet conveying device comprising:

a sheet discharge roller disposed in a conveying path of sheets so as to discharge a sheet being conveyed to a sheet discharge tray;

a conveying unit that conveys sheets on a side of the conveying path closer to an upstream side than the sheet discharge roller;

a motor that rotates at a constant system speed during conveying of sheets to drive the conveying unit;

a transmission mechanism that transmits power of the motor to the sheet discharge roller to rotate the sheet discharge roller;

a sheet end sensor configured to detect a front end and a rear end of a sheet being conveyed on the conveying path; and a controller that controls an operation of the transmission mechanism, wherein:

the transmission mechanism can change a circumferential speed of the sheet discharge roller during conveying of sheets, the controller performs speed reduction control of controlling the operation of the transmission mechanism to temporarily reduce the circumferential speed of the sheet discharge roller when it is determined, based on a detection result by the sheet end sensor, that a sheet is discharged to the sheet discharge tray, the conveying unit is a fixing unit that fixes a toner image transferred to a sheet to the sheet using a fixing roller, and the controller does not perform the speed reduction control when an operation mode of the sheet conveying device is a silence mode or a power consumption reduction mode.

* * * * *